United States Patent [19]

Hobson

[11] 4,441,401

[45] Apr. 10, 1984

[54] RACK AND PINION WEAPON ELEVATION MECHANISM

[75] Inventor: James C. Hobson, St. Clair Shores, Mich.

[73] Assignee: Ex-Cell-O Corporation, Troy, Mich.

[21] Appl. No.: 423,583

[22] Filed: Sep. 27, 1982

[51] Int. Cl.[3] ..... F41F 21/16; F41F 21/04; F41F 23/06; F41F 23/10

[52] U.S. Cl. ..... 89/37 F; 89/36 K; 89/41 H

[58] Field of Search ..... 89/41 R, 41 T, 41 H, 89/41 M, 36 K, 37 F, 39; 74/29, 33

[56] References Cited

U.S. PATENT DOCUMENTS

| | | | |
|---|---|---|---|
| 1,428,345 | 9/1922 | Standish | 89/37 F |
| 1,493,628 | 5/1924 | Hagenbucher | 89/41 H |
| 1,612,118 | 12/1926 | Hewlett et al. | 89/41 H |
| 2,017,083 | 10/1935 | Willink | 89/41 M X |
| 2,946,262 | 7/1960 | Bruehl | 89/37 F |
| 3,223,000 | 12/1965 | Payne et al. | 89/41 H X |
| 3,636,789 | 1/1972 | Geiger | 89/41 R X |
| 4,338,853 | 7/1982 | Neumeyer | 89/41 R |
| 4,353,283 | 10/1982 | Crepin | 89/41 T |

*Primary Examiner*—Donald G. Kelly

*Attorney, Agent, or Firm*—Edward J. Timmer

[57] ABSTRACT

A three rack and double pinion weapon elevation mechanism is disclosed and is useful for positioning and balancing a weapon, such as a cannon, on a combat vehicle. Two hydraulically-actuated gear racks are in facing relation with a main pinion in meshing engagement therebetween. The main pinion is integral with a shaft to which an output pinion is attached. Rotation of the main pinion produces an identical rotation of the output pinion. The output pinion is in mesh with a sector gear attached to the weapon. The two racks are slidable past the main pinion causing it and the output pinion to rotate in one direction or the other, producing a corresponding elevation or depression of the weapon. A third hydraulically-actuated rack is meshed with the main pinion to exert an elevating torque on the output pinion counter to a depressing torque exerted thereon by the weight of the weapon and which varies with changes in weapon elevation angle. A hydraulic accumulator arrangement pressurizes the third rack against the main pinion as a function of weapon position to automatically counter the depressing torque exerted by the weapon, thereby balancing the weapon on the combat vehicle.

8 Claims, 5 Drawing Figures

RACK AND PINION WEAPON ELEVATION MECHANISM

This invention was made in the course of work under a contract or subcontract thereunder with the Department of the Defense.

FIELD OF THE INVENTION

The present invention relates to a weapon elevation and balancing mechanism especially useful on combat vehicles.

BACKGROUND OF THE INVENTION

U.S. Pat. No. 3,223,000 issued Dec. 14, 1965 to Payne et al describes a hydraulic gun control system having a pressure differential sensing valve to automatically increase fluid pressure in the system to satisfy all load requirements encountered in the operation and control of the gun. In particular, this system is said to permit adequate traversing of a heavy gun in all types of terrain from level to inclined without stalling.

U.S. Pat. No. 3,636,789 issued Jan. 25, 1972 to Geiger describes a gear drive mechanism for armored turrets, rotary ring gun carriages and similar weapons wherein oppositely driven spur gears are placed in engagement with a counter gear directly coupled to the weapon elevation or traversing mechanism to provide play-free drive thereof.

There exists a need for a weapon elevation mechanism characterized as having weapon balancing means to offset variable forces generated in the mechanism by changes in the elevation of the weapon, having significantly reduced breakaway friction to improve low speed tracking and reduce dynamic errors when operating in the stabilized mode, having fewer and simpler components with elimination of hydraulic motor and speed reduction gearing and having a compact size and envelope compatible with restricted turret configurations.

SUMMARY OF THE INVENTION

An object of the invention is to provide a weapon elevation mechanism which possesses these characteristics and advantages.

In a typical working embodiment of the invention, the weapon elevation mechanism includes a rack and pinion assembly in which a weapon elevating rack means and weapon depressing rack means are in spaced, facing relation with a pinion means in meshing engagement therebetween. The rack means are hydraulically actuated and slidably mounted for movement past opposite sides of the pinion means causing it to rotate in one direction or the other. The pinion means includes an output pinion which in turn meshes with a driven gear means mounted to the side of the weapon. Linear motion of the hydraulically-actuated rack means in either direction produces an appropriate rotation of the pinion means and output pinion, in turn causing a corresponding rotation of the weapon about its trunnion axis which alters its elevation attitude.

Due to the configuration of the weapon, its weight, in particular that of its muzzle, exerts a depressing torque on the output pinion and in turn on the main pinion means. The magnitude of this depressing torque varies with the elevation angle of the muzzle with respect to the horizontal. An important feature of the invention is the provision of a third equilibrating or balancing rack means in meshing engagement with the pinion means and hydraulic pressurization means for loading the third rack means against the pinion means to exert a balancing torque, e.g., an elevating torque, on the pinion means including the output pinion which is counter to the depressing torque exerted by the weapon at any given weapon position. The weapon is thereby balanced on the combat vehicle.

In a preferred embodiment, the hydraulic pressurization means for the third rack means includes a remote hydraulic accumulator for varying hydraulic pressure on the third rack means and thus the balancing torque exerted on the pinion means including the output pinion as a function of weapon elevation to automatically counter changes in the depressing torque with changes in weapon elevation.

In another preferred embodiment, the weapon elevating rack means and weapon depressing rack means each include a piston at one end received in corresponding hydraulic cylinders of a housing. The hydraulic cyclinders are connected to a common source of hydraulic pressure with valve means, such as a servo valve, connected between the hydraulic cylinders and pressure source to create a controllable pressure differential between the cylinders and thereby cause relative linear motion of the elevating and depressing rack means. An advantage of this configuration is that the teeth of the rack means are always unidirectionally loaded against the pinion teeth and thus there is zero backlash within the assembly.

In still another preferred embodiment, the weapon elevating and depressing rack means as well as the equilibrating rack means are supported for sliding movement in the housing by linear roller bearings arranged in a self-aligning structure to evenly distribute the load on the rack means. The main pinion means and output pinion are also supported by rolling element bearings. This bearing arrangement significantly reduces frictional forces internal to the mechanism and allows movement of the weapon to be produced by a very low pressure differential between the hydraulic cylinders. This characteristic enhances the dynamic accuracy of the weapon control system when operating in stabilized mode and also improves the uniformity of low speed tracking operations.

In yet another preferred embodiment, the elevation mechanism is supported by a spring-loaded hinged mounting means to eliminate backlash between the output pinion of the mechanism and the driven gear means of the weapon.

The weapon elevation mechanism of the invention is compact in size and low in weight when compared to other devices of similar torque capacity. As a result, the mechanism exhibits improved compatibility with various turret configurations provided on combat vehicles. This compatibility is further enhanced by the integration of means to offset weapon unbalance within the mechanism. Because the device is comprised of relatively few components, its maintenance is facilitated and its cost is minimized.

DESCRIPTION OF PREFERRED EMBODIMENTS

Figure 1:
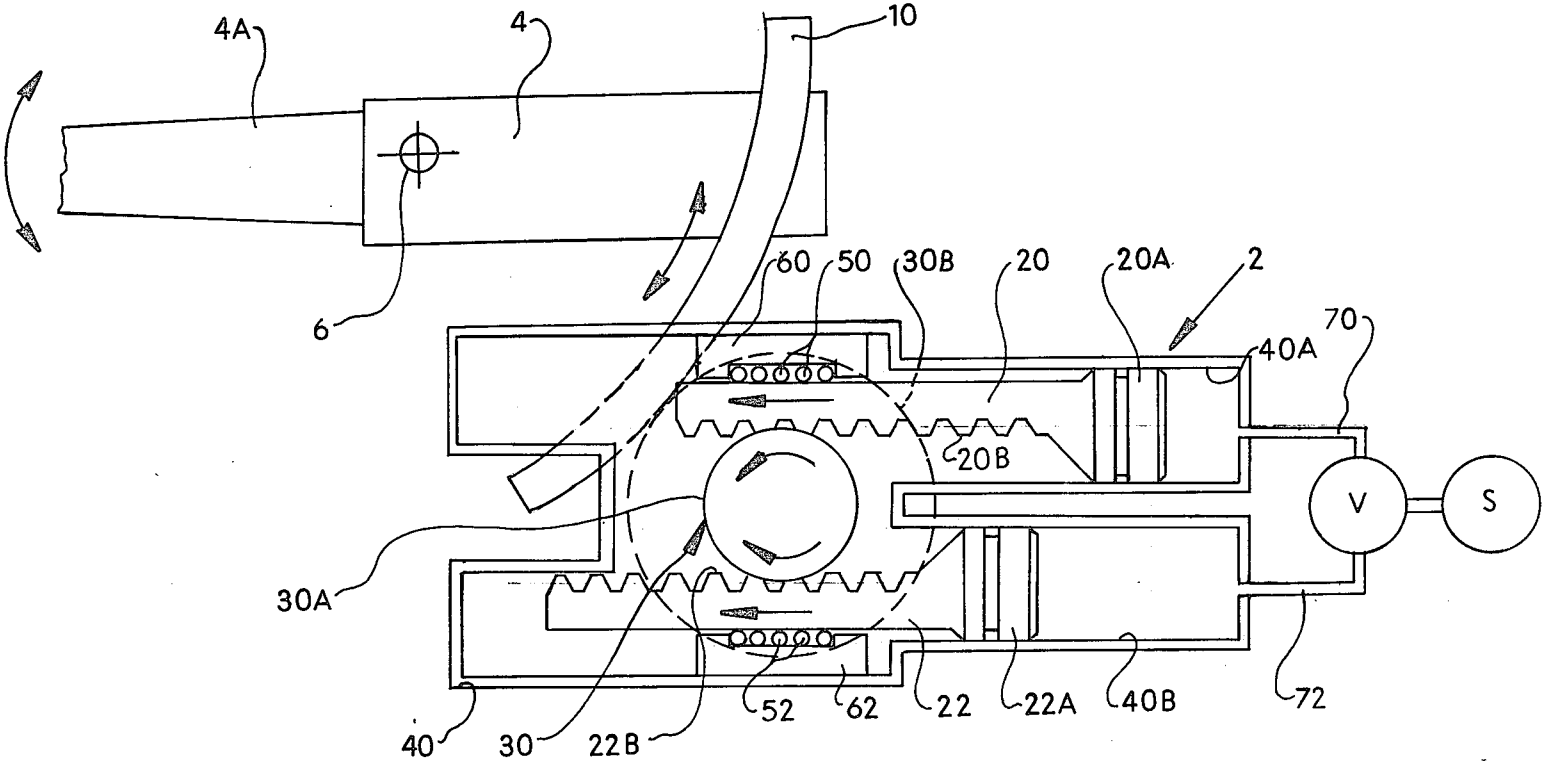
FIG. 1 is a fragmentary elevation of the weapon elevation mechanism with some features shown schematically.
Figure 3:
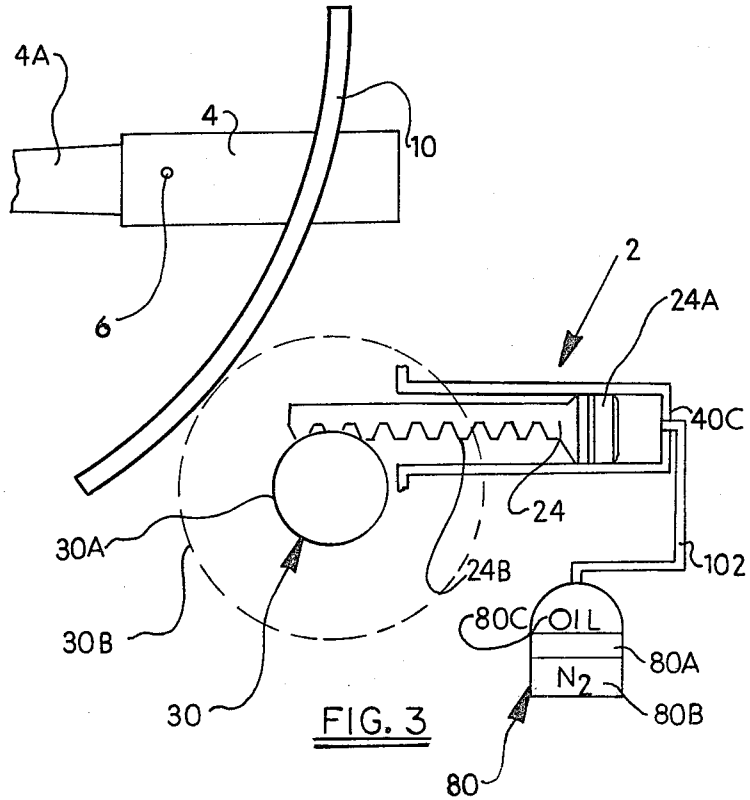
FIG. 3 is a fragmentary elevation of the weapon elevation mechanism showing the third equilibrating rack.
Figure 2:
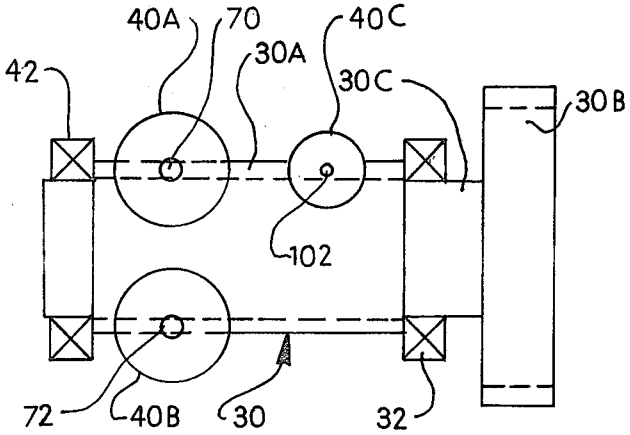
FIG. 2 is a schematic end elevation of the weapon elevation mechanism.

FIGS. 1–3 show a weapon elevation mechanism 2 of preferred construction for elevating and balancing a weapon such as a cannon 4 carried by a tank or other combat vehicle (not shown). The cannon 4 is mounted on a trunnion 6 in the usual manner and includes a sector gear 10 by which the cannon muzzle 4*a* is elevated or depressed by rotation of the cannon about trunnion 6.

The weapon elevation mechanism includes a three rack and double pinion assembly comprising a weapon elevating rack 20, a weapon depressing rack 22, a weapon balancing rack 24 and a double pinion assembly 30. The pinion assembly includes a main pinion 30*a* and output pinion 30*b* and is journaled by conventional bearings 32 in a housing 40. Typically, the output pinion 30*b* is a separate pinion gear bolted or otherwise attached to the shaft of the pinion assembly 30. Of course, the output pinion section 30*b* is in meshing engagement with the sector gear 10 to elevate or depress the weapon.

The elevating rack 20 and depressing rack 22 are mounted in the housing 40 by linear roller bearings 50 and 52 in bearing holders 60 and 62. The bearings 50 and 52 are self-aligning in their respective holders so as to uniformly distribute loads exerted on the racks 20 and 22 during operation. As shown most clearly in FIG. 1, the racks 20 and 22 include a piston 20*a* and 22*a* at one end and a toothed section 20*b* and 22*b* extending from the other end along the length of the rack. The rack pistons 20*a* and 22*a* are sealingly and slidably received in hydraulic cylinders 40*a* and 40*b* of the housing while the toothed sections 20*b* and 22*b* are in spaced, facing relation to the main pinion section 30*a* and in meshing engagement therewith. It is apparent that when rack 20 is moved to the left (relative to FIG. 1) the pinion assembly 30 will rotate counterclockwise and the output pinion thereof will move the sector gear 10 downwardly to elevate the cannon muzzle 4*a* about trunnion 6. Of course, movement of rack 22 to the left will cause output pinion 30*b* to rotate clockwise and depress the cannon muzzle 4*a*.

Movement of the weapon elevating rack 20 and weapon depressing rack 22 in this manner is effected by creating a hydraulic pressure differential between elevating cylinder 40*a* and depressing cylinder 40*b*. For example, the pressure lines 70, 72 are connected to a common source S, of hydraulic pressure with a servo valve, V, interposed between the pressure source S and cylinders 40*a*, 40*b* to vary the line pressure between the cylinders to cause relative movement of the racks 20, 22. To cause relative movement of rack 20 to the left in FIG. 1, and rack 22 to the right, a pressure of for example 1050 psi may be applied to cylinder 40*a* while a line pressure of 950 psi may be applied to cylinder 40*b* from a source at 2000 psi by moving the servo valve off-center the required amount. When the servo valve is in its centered position, the line pressure on each cylinder 40*a*, 40*b* is equal, e.g., 1000 psi, and there is no relative movement of racks 20, 22. A servo valve found suitable for use in the hydraulic system is sold as Series 30 by MOOG Inc., Aurora, N.Y.

FIG. 1 shows the cannon muzzle 4*a* in a horizontal position. In this position, an unbalancing torque is exerted on the output pinion 30*b* by the weight of the muzzle 4*a* acting through trunnion 6 and sector gear 10. For example, the muzzle weight tends to raise the sector gear 10 and this in turn exerts a depressing torque on the output pinion 30*b*, that is, a torque tending to rotate output pinion 30*b* as well as main pinion 30*a* in the clockwise direction. Of course, the magnitude of this depressing torque will depend on the weapon weight and the location of the weapon center-of-gravity with respect to the location of the trunnion (fulcrum) axis, but in one particular case there was about 1500 lb.-ft. torque unbalance on the output pinion 30*b* in the clockwise direction.

The situation is further complicated by the fact that this unbalancing torque on output pinion 30*b* will vary with the elevation of the cannon muzzle. For example, the unbalancing torque at any elevation will be equal to the maximum unbalancing torque exerted by the cannon muzzle 4*a* in the horizontal position (FIG. 1) multiplied by the cosine of the elevation angle of the weapon. Thus, as the cannon muzzle is elevated, the unbalancing torque will decrease according to the cosine function.

Figure 4:
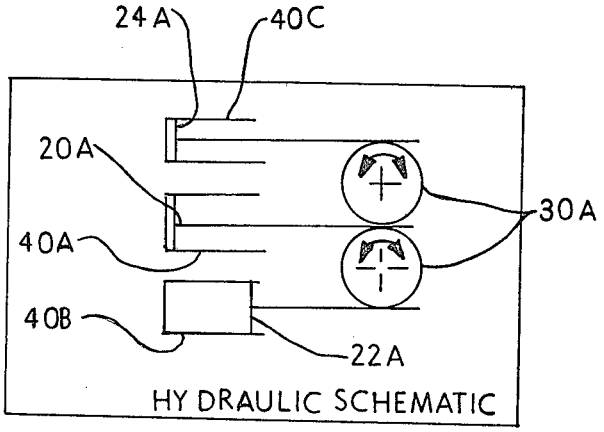
FIG. 4 is a schematic of the hydraulic system when the weapon is fully depressed.

I counter this variable unbalancing torque by employing the equilibrating rack 24 together with the hydraulic accumulator 80 as shown in FIGS. 2, 3 and 4. The equilibrating rack 24 is similar in construction to the elevating and depressing racks 20, 22 and includes a piston 24*a* at one end and a toothed section 24*b* extending from the other end. The rack 24 is slidably mounted in the housing 40 by similar linear roller bearings (not shown) in a similar bearing holder (not shown). It is apparent that the housing is provided with a hydraulic cylinder 40*c* in which the equilibrating rack piston 24*a* is sealingly and slidably received. The cylinder 40*c* is connected by line 102 to the hydraulic accumulator 80 which comprises a diaphragm 80*a* separating pressurized nitrogen 80*b* or other gas and an oil reservoir 80*c*.

The equilibrating rack 24 is intended to exert an elevating torque on main pinion 30*a* (counterclockwise torque) which counters for the most part the depressing torque exerted thereon by the weight of muzzle 4*a* at any given position or elevation.

For example, when the cannon muzzle 4*a* is in the horizontal position (FIGS. 1 and 3), the depressing torque is maximum and the nitrogen pressure in the accumulator 80 is selected at such a level that the hydraulic biasing force on the equilibrating rack 24 will counterbalance the muzzle depressing torque on the output pinion 30*b* and this main pinion 30*a*. In particular, the balancing torque exerted by the rack 24 will be in the elevating (or counterclockwise) direction relative to the pinion assembly 30 and equal in magnitude to the depressing torque exerted thereon by the muzzle 4*a* so that the cannon will be balanced. As the cannon muzzle 4*a* is elevated, the depressing torque will decrease as the cosine of the elevation angle. The elevating torque exerted by the equilibrating rack 24 will decrease with the decrease in the depressing torque by virtue of the rack piston 24*a* being moved to the left (in FIG. 3) by pinion 34 and creating more volume for oil in the accumulator system. This piston motion draws oil 80*c* from the accumulator 80 and reduces the nitrogen gas pressure by virtue of expansion of diaphragm 80*a*. The net effect is a reduction in the pressurization or balancing force exerted on the equilibrating rack 24 as the cannon muzzle is elevated. This balancing or elevating torque exerted by the equilibrating rack 24 can be made to vary with the cosine of the muzzle elevation angle by selecting suitable values for the equilibrating rack travel, piston area, accumulator volume, and initial gas pressure and is well within the skill of the art.

The present invention thus provides an elevation mechanism for elevating and depressing a weapon and at the same time balancing the weapon at any given position.

Figure 5:
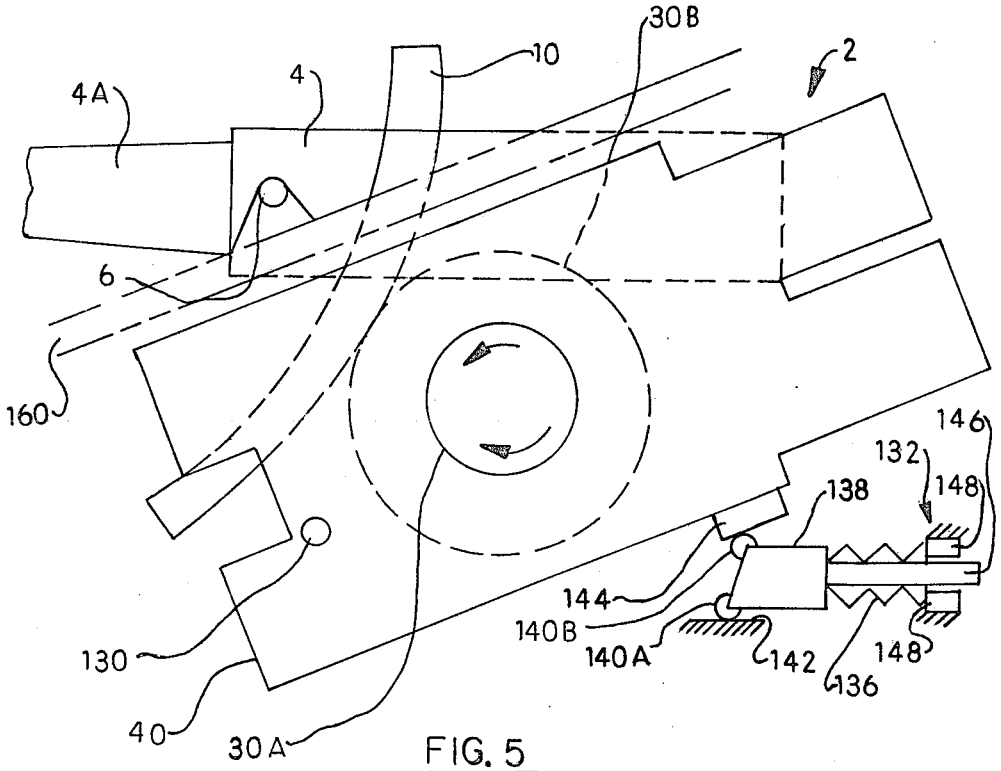
FIG. 5 is a fragmentary elevation similar to FIG. 1 with some features shown schematically illustrating mounting of the elevation mechanism in the vehicle.

The weapon elevation mechanism 2 is typically mounted to the turret or roof 160 of a tank by a spring-loaded hinge mounting means as shown in FIG. 5. This particular mounting is advantageous as a means for eliminating backlash between the output pinion **30*b* and the mating weapon sector gear 10. The hinge mounting means includes a pivot shaft 130 fastened by any suitable means to the housing 40 and having opposite ends received in conventional split spherical bearings (not shown) supported on the tank structure, e.g., on bulkheads, so that the shaft is pivotable and its axis can be positioned to insure proper meshing of the teeth of the output pinion and weapon sector gear. A spring-loaded mechanism 132 biases the output pinion 30*b* against the weapon sector gear 10 by including a spring washer 136 which biases member 138 to the left in FIG. 5. Member 138 includes a pair of rollers 140*a* (only one shown) riding on a plate 142 attached to the tank structure (bulkhead) and another roller 140*b* riding against a plate 144 secured to housing 40. The member 138 has a shaft 146 attached thereto extending through the spring washer 136 and bushing 148 mounted on the tank structure. The mechanical advantage of the spring-loaded hinge mechanism just described is increased by inclining the plate 144 relative to plate 142 as shown in FIG. 5**.

Of course, the above described weapon elevation mechanism is applicable for use with a breech heavy weapon as well as the muzzle heavy weapon described and modification of the mechanism for use with a breach-heavy weapon is well within the skill of the art. While there have been described what are considered to be certain preferred embodiments of the invention, other modifications, additions and the like will occur to those skilled in the art and it is intended to cover in the appended claims all such modifications and the like as fall within the spirit and scope of the invention.

I claim:

1. An elevation mechanism for an unbalanced weapon having driven gear means, comprising a rotatably mounted pinion means in meshing engagement with the driven gear means to elevate or depress the weapon depending on the direction of pinion rotation, a pair of rack means in meshing engagement with said pinion means with one rack means slidably mounted on a side of the pinion means and the other rack means slidably mounted on a side thereof such that said one rack means causes elevation of the weapon and said other rack means causing depression of the weapon, means for moving said rack means past the pinion means to rotate same in one direction or the other, and further comprising a third rack means in meshing engagement with the pinion means and means for loading the third rack means against the pinion means to exert a torque thereon counter to a torque exerted on the pinion means by the unbalanced weapon.

2. The weapon elevation mechanism of claim 1 wherein the rack loading means comprises a hydraulic cylinder means for moving said third rack and hydraulic accumulator means for pressurizing said cylinder means and thus varying force on the third rack means as a function of weapon position.

3. The weapon elevation mechanism of claim 1 wherein the rack moving means comprises hydraulic cylinder means associated with each rack means of said pair and connected to a common source of hydraulic pressure by valve means which, when actuated, causes a pressure differential between the rack cylinder means and relative linear movement of said racks means in opposite directions past the pinion means.

4. An elevation mechanism for an unbalanced weapon having driven gear means, comprising a rotatably mounted pinion means including a main pinion and output pinion, said output pinion being in meshing engagement with the driven gear means to elevate or depress the weapon depending on the direction of output pinion rotation, first and second rack means slidably mounted in facing relation on opposite sides of the main pinion in meshing engagement therewith, said first rack means elevating the weapon and said second rack means depressing the weapon, hydraulic means for moving the first and second rack means relative to one another past the main pinion in opposite directions, said hydraulic means including first and second hydraulic cylinder means associated with the respective rack means for sliding same, a common source of hydraulic pressure to which the first and second cylinder means are connected and valve means between the source and first and second cylinder means for creating a pressure differential between the first cylinder means and second cylinder means to cause said first rack means and second rack means to move relative to one another past the main pinion to rotate same in one direction or the other, and further comprising a third equilibrating rack means in meshing engagement with the main pinion and hydraulic pressurization means for biasing the third rack means against the main pinion to exert an elevating torque thereon counter to a depressing torque exerted on the output pinion by the weapon at a given position, said biasing means including a third hydraulic cylinder means for biasing the third rack means against the input pinion and hydraulic accumulator means for applying pressure on said third cylinder means and thus biasing force on the third rack means as a function of weapon position.

5. The weapon elevation system of claim 4 wherein the first rack means and third rack means are disposed on one side of the main pinion and the second rack means is disposed on the other opposite side thereof.

6. The weapon elevation mechanism of claim 4 wherein the hydraulic accumulator means comprises a pressurized hydraulic source.

7. The weapon elevation mechanism of claim 6 wherein the pressurized hydraulic source comprises a gas-pressurized, diaphragm or piston-type hydraulic accumulator.

8. The weapon elevation mechanism of claim 4 wherein the first and second rack means are supported for sliding movement by linear roller bearings which are self-aligning to provide uniform load distribution.

* * * * *